US005284816A

United States Patent [19]

Stephenson

[11] Patent Number: 5,284,816

[45] Date of Patent: Feb. 8, 1994

[54] TWO-SIDED THERMAL PRINTING SYSTEM

[75] Inventor: Stanley W. Stephenson, Spencerport, N.Y.

[73] Assignee: Eastman Kodak Company, Rochester, N.Y.

[21] Appl. No.: 978,855

[22] Filed: Nov. 19, 1992

[51] Int. Cl.[5] ..... B41M 5/035; B41M 5/38

[52] U.S. Cl. ..... 503/227; 428/195; 428/212; 428/213; 428/216; 428/334; 428/335; 428/336; 428/913; 428/914; 503/200; 503/204; 503/226

[58] Field of Search ..... 8/471; 428/195, 484, 428/488.1, 488.4, 913, 914, 212, 213, 215, 216, 332, 334–336, 412, 523; 503/227, 200, 226, 201, 204, 214

[56] References Cited

U.S. PATENT DOCUMENTS

| | | | |
|---|---|---|---|
| 2,333,172 | 11/1943 | Grupe | 101/157 |
| 2,730,456 | 1/1956 | Green et al. | 117/36 |
| 2,730,457 | 1/1956 | Green et al. | 117/36 |
| 3,244,548 | 4/1966 | Sullivan | 117/36.2 |
| 3,244,550 | 4/1966 | Farnham et al. | 117/36.2 |
| 3,329,088 | 7/1967 | Rockefeller, Jr. | 101/426 |
| 3,539,375 | 11/1970 | Baum | 117/36.2 |
| 3,560,229 | 2/1971 | Farnham et al. | 106/21 |
| 3,674,535 | 7/1972 | Blose et al. | 117/36.8 |
| 3,920,510 | 11/1975 | Hatano et al. | 162/162 |
| 3,968,299 | 7/1976 | Angleman | 428/307 |
| 4,138,357 | 2/1979 | Igarashi | 252/188.3 |
| 4,168,845 | 9/1979 | Oeda et al. | 282/27.5 |
| 4,287,264 | 9/1981 | Marginean | 428/514 |
| 4,287,535 | 9/1981 | Marginean et al. | 106/19 |
| 4,399,188 | 8/1983 | Yamato et al. | 428/320.4 |
| 4,500,896 | 2/1985 | Kubo et al. | 346/204 |
| 4,541,830 | 9/1985 | Hotta et al. | 8/471 |
| 4,604,635 | 8/1986 | Wiklof et al. | 346/226 |
| 4,675,705 | 6/1987 | Marginean et al. | 503/209 |
| 4,688,057 | 8/1987 | Ueyama | 503/204 |
| 4,804,977 | 2/1989 | Long | 346/76 L |
| 4,940,689 | 7/1990 | Ito | 503/202 |
| 4,940,993 | 7/1990 | Sato | 346/76 PH |
| 4,956,251 | 9/1990 | Washizu et al. | 430/138 |
| 4,962,386 | 10/1990 | Hakkaku et al. | 346/1.1 |
| 5,061,677 | 10/1991 | Yoshida et al. | 503/226 |
| 5,101,222 | 3/1992 | Hakkaku | 346/76 PH |
| 5,114,904 | 5/1992 | Kawakami et al. | 503/227 |
| 5,115,255 | 5/1992 | Kobayashi et al. | 346/76 PH |

FOREIGN PATENT DOCUMENTS

| | | |
|---|---|---|
| 57-69071 | 4/1982 | Japan . |
| 58-8668 | 1/1983 | Japan . |
| 61-3765 | 1/1986 | Japan . |
| 61-139465 | 6/1986 | Japan . |
| 61-192572 | 8/1986 | Japan . |
| 61-202863 | 9/1986 | Japan . |
| 62-113571 | 5/1987 | Japan . |
| 63-183865 | 7/1988 | Japan . |
| 2-4555 | 1/1990 | Japan . |

OTHER PUBLICATIONS

IBM Technical Disclosure vol. 24, No. 1A Jun. 1981, Kuntzleman et al, Double Sided Printer.

*Primary Examiner*—B. Hamilton Hess
*Attorney, Agent, or Firm*—Raymond L. Owens

[57] ABSTRACT

A two sided thermal printing system includes a sheet which is specially coated on both sides for two sided thermal printing. A first side of the sheet has a dye receiving first coating for heat flowable dye transfer thermal printing via a dye bearing web in a transfer printing step. An opposing second side of the sheet has a second coating containing a heat activated dye material for forming, in situ, a dye image by direct thermal printing in an in situ printing step. The sheet portion, exclusive of the second coating, has a sufficient thickness and thermal resistance for inhibiting heat transfer therethrough during the transfer printing step on the first side to prevent activation of the dye material in the second coating on the second side.

17 Claims, 1 Drawing Sheet

TWO-SIDED THERMAL PRINTING SYSTEM

FIELD OF THE INVENTION

This invention relates to a two sided thermal printing system comprising a sheet with an image receiving coating on one side and an image forming coating on the other side for two sided thermal printing thereof.

BACKGROUND OF THE INVENTION

Various printing systems are known for recording (printing) character (text) or graphic (picture) images on a recording medium (receiver sheet) such as a paper or polymer sheet. These include:

(1) liquid ink printing systems as used in printing presses;

(2) two-sheet pressure transfer inert ink printing systems as used in mechanical print head, stylus (pen) and like printers (pressure printers);

(3) two-sheet heat transfer flowable dye printing systems as used in thermal print head, stylus (pen), laser and like printers (thermal printers);

(4) two-sheet pressure transfer reactive dye printing systems as used in pressure printers;

(5) one-sheet in situ pressure reactive dye printing systems as used in pressure printers; and (6) one-sheet in situ heat reactive dye printing systems as used in thermal printers, such as telephone transmission facsimile printers (FAX machines).

(2) Two-sheet pressure transfer inert ink printing systems typically have an inert one-component colorant, formed of a pigment or dye containing liquid or paste, selectively transferred by printer pressure from a carrier medium (transfer sheet) such as a dye bearing ribbon (donor web) to a receiving medium (receiver sheet) to form images thereon.

(3) Two-sheet heat transfer flowable dye printing systems typically have a heat sensitive one-component colorant, formed of a pigment or dye containing meltable, e.g., waxy, solid ink or a diffusible (sublimable) dye such as an anthraquinone dye, selectively transferred by thermal printer heat ( e.g., Joule heat) from a transfer sheet such as a donor web to a receiver sheet to form images thereon.

(4) Two-sheet pressure transfer reactive dye printing systems typically have a pressure sensitive two-component particulate colorant, formed of a colorless or lightly (pale) colored dye precursor (leuco dye) such as crystal violet lactone (hereinafter CVL), i.e., 3,3-bis (4-dimethylamino phenyl)-6-dimethylamino phthalide, or malachite green lactone (hereinafter MGL), i.e., 3,3-bis (p-methylamino phenyl) phthalide, and a color developer such as bisphenol A, i.e., 4,4'-isopropylidene diphenol. Particles of one component are dispersed in a coating on a transfer sheet and particles of the other component are dispersed in a facing coating on a receiver sheet. At least one of the components is, or is contained in, a liquid, e.g., enclosed in pressure rupturable microcapsules, and is selectively transferred by printer pressure from its coating into reactive contact with the other component in the other coating to develop the dye precursor to color state and form images on the receiver sheet coating.

(5) One-sheet in situ pressure reactive dye printing systems typically have a pressure sensitive two-component colorant, formed of particles of the dye precursor such as CVL, and particles of the color developer such as bisphenol A, dispersed in a coating on a receiver sheet, yet maintained out of reactive contact with each other. At least one of the components is, or is contained in, a liquid, e.g., enclosed in pressure rupturable microcapsules, and is selectively transferred by printer pressure into reactive contact with the other component to develop the dye precursor to color state and form, in situ, images in the receiver sheet coating.

(6) One-sheet in situ heat reactive dye printing systems typically have a heat sensitive two-component colorant formed of particles of the dye precursor such as CVL, and particles of the color developer such as bisphenol A, dispersed in a coating on a receiver sheet for heat reactive contact. At least one of the components is, or is contained in, a meltable substance, e.g., bisphenol A, and is selectively melted and transferred at a given activation temperature by thermal printer heat ( e.g., Joule heat) into reactive contact with the other component, e.g., CVL, to develop the dye precursor to color state and form, in situ, images in the receiver sheet coating.

These printing systems and hybrid variations thereof are illustrated by the following prior art references [1] to [41].

References [1] to [12] concern identical two sided printing systems, and in one case a one sided transfer printing system.

[1] Grupe U.S. Pat. No. 2,333,172, issued Nov. 2, 1943; [2] Rockefeller, Jr. U.S. Pat. No. 3,329,088, issued Jul. 4, 1967; and [3] Dahlgren U.S. Pat. No. 4,208,963, issued Jun. 24, 1980, commonly disclose identical system liquid ink printing of both sides of a web.

Japanese Patent Document (English Abstract) [4] JP 4,555/90 to Imamura, dated Jan. 9, 1990, discloses a one sided two-sheet pressure transfer inert ink system in which printer pressure transfers an ink character from an ink ribbon to a roller which transfers it to the back side of a photosensitive sheet carrying an already exposed, but still undeveloped, image on its front side.

Japanese Patent Document (English Abstract) [5] JP 139,465/86 to Hamada, dated Jun. 26, 1986, discloses a pair of ink ribbons and associated print heads on opposed sides of a paper sheet for respective identical system printing on both sides of the sheet. It is unclear whether the ribbons are of the pressure transfer inert ink, or heat transfer flowable dye, type.

Japanese Patent Documents (English Abstracts) [6] JP 69,071/82 to Moriguchi, dated Apr. 27, 1982; [7] JP 202,863/86 to Watanabe, dated Sep. 8, 1986; and [8] JP 183,865/88 to Noaki, dated Jul. 19, 1988, commonly disclose a pair of ink ribbons and associated thermal print heads on opposed sides of a recording sheet for respective identical system heat transfer flowable dye printing on both sides of the sheet.

Japanese Patent Documents (English Abstracts) [9] JP 3,765/86 to Shimizu, dated Jan. 9, 1986 ([9] Shimizu JP '765); [10] JP 192,572/86 to Teraichi, dated Aug. 27, 1986 ([10] Teraichi JP '572); and [11] JP 113,571/87 to Teraichi, dated May 25, 1987 ([11] Teraichi JP '571), commonly disclose a pair of thermal heads on opposed sides of a paper sheet for respective identical system thermal printing on both sides of the sheet. The type of image recording performed is not indicated.

Japanese Patent Document (English Abstract) [12] JP 8,688/83 to Murakami, dated Jan. 18, 1983 ([12] Murakami JP '688), discloses a pair of thermal print heads on opposed sides of a paper sheet which is heat sensitive on both sides for respective identical system thermal printing on both such sides. The nature of the heat sensitive sides of the sheet is not indicated.

References [13] to [15] concern heat flowable dye transfer printing systems.

[13] Hotta et al. U.S. Pat. No. 4,541,830, issued Sep. 17, 1985 ([13] Hotta), discloses a two-sheet heat transfer flowable dye printing system having a transfer sheet bearing a sublimable dye which is flow transferred by a thermal head or laser beam to a receiver sheet to form images thereon. The dye may be one which sublimes below 100 degrees C. (column 5). The receiver sheet may be active clay coated paper.

[14] Long U.S. Pat. No. 4,804,977, issued Feb. 14, 1989 ([14] Long), which is assigned to the same assignee as the present invention, is similar to [13] Hotta. The receiver sheet may be a substrate of paper or of polyethylene terephthalate (hereinafter PET) film, with a receiving coating, e.g., of polycarbonate, which absorbs and retains the transferred dye images to give a bright hue and prevent subsequent dye wandering.

[15] Kawakami et al. U.S. Pat. No. 5,114,904, issued May 19, 1992, is to the same effect as [13] Hotta. The dye may be a sublimable or hot melt transfer dye. The receiver sheet may be a substrate of paper, polypropylene resin synthetic paper, e.g., of 150 micron (0.006 inch) thickness, or an inorganic sheet, with a receiving coating, e.g., of 5 micron (0.0002 inch) thickness, containing a dye permeating lubricant silicone resin, a high softening point and high glass transition point thermoplastic polymer resin, and a powdered inorganic filler.

References [16] to [20] concern pressure reactive dye transfer and in situ printing systems.

[16] Green et al. U.S. Pat. No. 2,730,456, issued Jan. 10, 1956 ([16] Green '456), discloses a two-sheet pressure transfer reactive dye printing system having a transfer sheet with a coating of microcapsules enclosing a liquid such as a water immiscible oil, carrying a dye precursor such as CVL or MGL, and a receiver sheet with a facing coating of a color developer such as an acid clay-like material. Printing pressure rupture of the microcapsules causes the liquid carrying the precursor dye to flow into reactive contact with the color developer to change the dye precursor to color state and form marks on the receiver sheet.

[17] Green et al. U.S. Pat. No. 2,730,457, issued Jan. 10, 1956, is to the same effect as [16] Green '456, but also discloses a one-sheet in situ pressure reactive dye printing system formed of a receiver sheet with a coating including both the microcapsules of the liquid containing the dye precursor such as CVL or MGL, and particles of the acid clay-like material. Microcapsule rupture causes the liquid carrying the dye precursor to contact and react with adjacent color developer particles in the same coating to form color marks. The disclosure describes the dye precursor as an electron donor compound having a double bond system, and the color developer as an electron acceptor which is acid relative thereto, the electron donor compound being converted to a more highly polar conjugated form giving it a distinctive color, upon reaction with the color developer.

[18] Sullivan U.S. Pat. No. 3,244,548, issued Apr. 5, 1966 ([18] Sullivan), is to the same effect as [16] Green '456, but uses a phenolic substance such as phenol, di- and tri-hydroxy phenols and 1- and 2-naphthol (columns 1 and 6–7) as color developer for the dye precursor, e.g., CVL or MGL (column 16). Many dye precursors are disclosed (columns 1, 5 and 12–24).

[19] Farnham et al. U.S. Pat. No. 3,244,550, issued Apr. 5, 1966 ([19] Farnham '550), is to the same effect as [18] Sullivan, disclosing many dye precursors (columns 18–30) including CVL (column 23) and MGL (column 22), plus biphenols (columns 3, 5 and 18–30) including bisphenol A (column 11) as color developers.

[20] Angleman U.S. Pat. No. 3,968,299, issued Jul. 6, 1976, discloses a two-sheet pressure transfer reactive dye printing system, with multiple component coatings on both sides of a pair of interchangeable transfer and receiver sheets, but operating like the system of [16] Green '456.

References [21] to [23] are mainly pertinent as concerning heat dependent, reversibly reactive dye development systems. [21] Farnham et al. U.S. Pat. No. 3,560,229, issued Feb. 2, 1971 ([21] Farnham '229), is to the same effect as [18] Sullivan, disclosing many dye precursors (columns 3–15) including CVL and MGL (column 7), and phenolic substances (columns 15–32) including bisphenol A (column 19) as color developers. It further discloses (column 37), inter alia, that if a dye precursor is dissolved in a certain type glycol ether, a permanent color forms on heating to about 150 degrees C., whereas if it is dissolved in a certain type phenol compound of low vapor pressure, which phenol compound is either liquid at room temperature or dissolved in certain organic solvents, a color forms at room temperature which disappears on heating to about 130 degrees C. and reversibly reappears on cooling back to room temperature.

[22] Igarashi U.S. Pat. No. 4,138,357, issued Feb. 6, 1979 ([22] Igarashi), discloses a one-sheet in situ heat reactive dye recording system formed of a receiver sheet with a coating of a reversibly color changing mixture of an electron donating color former such as CVL or MGL (column 2), i.e., a dye precursor, and a meltable special oxy benzoic acid ester (i.e., a hydroxy benzoate and thus a phenolic compound) having a melting point (mp) of about 50–200 degrees C. as electron accepting compound (columns 3–5), i.e., a color developer. On heating to melt the color developer, the mixture forms a color, and on cooling to crystallize the color developer, it returns to colorless state. In a given example (Example 1), a mixture of CVL and propyl p-oxy benzoate in a weight ratio of 1:100, coated on a paper sheet, changes from 0.09 optical density (colorless state) at normal temperature to 1.02 optical density (color state) when heated to 150 degrees C.

[23] Ito U.S. Pat. No. 4,940,689, issued Jul. 10, 1990, discloses a one-sheet in situ heat and electric current reactive recording cell. The cell is formed as a multilayer receiver sheet with an internal color forming layer of an oxidation-reduction dye such as CVL or MGL (column 3), and an electrolyte such as an aliphatic quaternary ammonium salt, in an insulating polymer medium which can dissolve the dye and electrolyte and which is liquid-solid transformable on heating and cooling. The dye reversibly changes from colorless to color state by applying heat to liquify the color forming layer and then electric current to induce an oxidation-reduction reaction of the dye.

References [24] to [33] concern heat reactive dye in situ printing systems.

[24] Baum U.S. Pat. No. 3,539,375, issued Nov. 10, 1970 ([24] Baum), discloses a one-sheet in situ heat reactive dye printing system formed of a receiver sheet with a heat activated image forming coating of a matrix of polyvinyl alcohol (hereinafter PVA) containing a mixture of CVL as dye precursor, and a solid phenol compound as acidic material, i.e., color developer, which liquifies and/or vaporizes at the usual thermographic temperatures of 150–200 degrees C., such as bisphenol A, mp 156 degrees C. (columns 3–4). Many phenol compounds and their melting points, ranging from a low of 86, to a high of 184, degrees C., are disclosed (columns 1–6). The coating has, by weight, 1–15% CVL, 45–94% phenol compound and 5.40% PVA. Heat activates the coating to develop an image by liquifying and/or vaporizing the phenol compound for reactive contact with the CVL. In a given example (Example I), a paper sheet is coated with a layer of 3% CVL and 67% bisphenol A (both of 1.3 micron particle size) in 30% PVA.

[25] Blose et al. U.S. Pat. No. 3,674,535, issued Jul. 4, 1972, is to the same effect as [24] Baum, with the image forming coating having a filler such as clay, a lubricant such as zinc stearate and a nontacky wax, e.g., of mp 140–143 degrees C., to inhibit sticking of the coating material to the thermal print head which liquifies and/or vaporizes the phenol compound such as bisphenol A for color developing the CVL.

[26] Hatano et al. U.S. Pat. No. 3,920,510, issued Nov. 18, 1975, is to the same effect as [24] Baum, with the dye precursor being a specific type fluoran compound (columns 2–18). In the use example (Example 18), a paper sheet is coated with, by weight (calculated), 3% 2-p-chloroanilino-3-methyl-6-dimethylamino fluoran as dye precursor and 67% bisphenol A as phenol compound, i.e., color developer, in 30% PVA as matrix.

[27] Oeda et al. U.S. Pat. No. 4,168,845, issued Sep. 25, 1979 ([27] Oeda), is to the same effect as [24] Baum, with the image forming coating having particles of the dye precursor such as CVL or MGL (column 2), and of the color developer such as bisphenol A (column 3), at least one of which are meltable particles providing a meltable color forming material. Oil absorption pigment particles of silicon dioxide, diatomaceous earth, etc., are added to absorb the melted color forming material to prevent its sticking to the thermal print head. Besides other additives, 10–40% of the solid content coating weight may be a binder such as PVA, gum arabic, starch, etc.

[28] Marginean U.S. Pat. No. 4,287,264, issued Sep. 1, 1981 ([28] Marginean '264), is to the same effect as [24] Baum. The receiver sheet has an image forming coating of PVA as carrier (binder, matrix) containing a mixture of a color forming amount of a finely divided homogeneous basic 3,3-bisaryl phthalane derivative such as CVL as dye precursor, and a color developing amount of a finely divided solid phenol derivative such as bisphenol A as acidic phenolic color developer, which at thermal printing temperature is at least partly fluidizable and capable of a color forming reaction with the dye precursor. An anti sticking amount of a functional filler is added to prevent the fluidized color developer from sticking to the thermal print head. A coating composition may have, by weight, 2–30% CVL, 16–36% bisphenol A, and 2–60% functional filler, e.g., zinc di-n-butyl dithiocarbamate (hereinafter butyl zimate), relative to the total solids in the composition. A given coating on a paper sheet (Example I) has, by weight, 3% CVL and 27% bisphenol A (both of 1–3 micron particle size), 30% PVA and 40% butyl zimate, and optionally talc.

[29] Marginean et al. U.S. Pat. No. 4,289,535, issued Sep. 15, 1981 ([29] Marginean '535), is cumulative to [28] Marginean '264. The PVA carrier of [28] Marginean '264 is replaced by a carrier composition of a substantially water soluble anionic polysaccharide gum such as gum arabic (about 16–50%) and a stability enhancing amount of sucrose benzoate (about 3–10%) as binder-carrier. This forms an image forming coating with the finely divided solid (1–3 micron particle size) chromogenous basic 3,3-bisaryl phthalane derivative such as 6-dimethylamino-3,3-bis (p-dimethylamino phenyl) phthalide, i.e., CVL (column 8), or 3,3-bis (p-dimethylamino phenyl) phthalide, i.e., MGL (column 6), as dye precursor, and finely divided solid (1–3 micron particle size) phenol derivative such as bisphenol A as color developer. The color developer is at least partially fluidizable at the printing temperature. Also includable are a functional filler (about 2–12%) such as zinc di-n-butyl dithiocarbamate, i.e. butyl zimate, and a pressure sensitivity eliminating agent such as a micronized polyolefin, or micronized modified (fluorinated) polyolefin, of 1,000 to 2,000 molecular weight (mol. wt.) and 240–700 degrees F. (116–371 degrees C.) mp to prevent pressure color development as occurs with pressure reactive dye printing systems. A preferred coating has, by weight, about 9–30% CVL, 16–36% bisphenol A, 16–50% gum arabic, 3–10% sucrose benzoate, 2–12% zinc zimate, and 2–12% high mol. wt. polyethylene or fluorinated polyethylene of about 240–700 degrees F. (116–371 degrees C.) mp. A given coating applied to a paper sheet (Example I) has, by weight, 11.10% CVL, 33.53% bisphenol A, 32.96% gum arabic, 6.07% sucrose benzoate, 8.17% butyl zimate, and 8.17% high mol. wt. polyethylene of above 500 degrees F. (260 degrees C.) mp.

[30] Yamato U.S. Pat. No. 4,399,188, issued Aug. 16, 1983 ([30] Yamato), discloses a one-sheet in situ heat reactive dye printing system formed of a receiver sheet with an image forming coating of a colorless or pale colored chromogenic fluoran type dye such as 3-diethylamino-6-methyl-7-anilino fluoran, and a specific type p-hydroxy benzoic acid ester (i.e., a first phenolic compound) of about 60–120 degrees C. mp as color developer, such as p-hydroxy benzoic acid ethyl ester or benzyl ester, plus a phenol substance (i.e., a second phenolic compound) of above 90 degrees C. mp, i.e., other than bisphenol A (Reference Example 1-a), such as 4,4'-butylene-bis (3-methyl-6-tertiary butyl phenol), which when used with said benzoic acid ester lowers the degree of yellowing on storage of the receiver sheet. A suitable formulation contains, by weight, per part of the fluoran type dye, 3–10 parts of said benzoic acid ester (first phenolic compound), 1–5 parts of the phenolic substance (second phenolic compound), 1–20 parts of an inorganic or organic filler such as kaolin, diatomaceous earth, talc, etc., plus 1–20%, per total solid content, of a binder such as PVA, starch, etc., and optional additives including a releasing agent such as a metal salt of a fatty acid, e.g., zinc stearate. Triphenylmethane phthalide type dyes such as CVL, rhodamine type dyes, spiropyran type dyes and leuco auramine type dyes are unsuitable in the formulation containing said benzoic acid ester as the color formed upon heating tends to discolor with the lapse of time. Thus, if CVL were used as dye precursor in this low melting point hydroxy benzoic acid ester containing coating, it would apparently function reversibly like the coating of [22] Igarashi which contemplates CVL and a similar hydroxy benzoic acid ester as phenolic compound, i.e., color developer.

[31] Wiklof et al. U.S. Pat. No. 4,604,635, issued Aug. 5, 1986 ([31] Wiklof), discloses a one-sheet in situ heat reactive dye printing system formed of a receiver sheet with an image forming inner coating of a leuco dye or metallic salt as dye precursor and an acidic material as color developer capable of coloring the leuco dye or metallic salt when heat is applied. A protective outer coating of a cured silicone resin on the inner coating contacts the thermal print head to prevent sticking thereto of the image forming coating ingredients. The silicone resin amount should not exceed 10 pounds per 3,000 sq. ft. of the receiver sheet (substrate) or the outer coating thickness will be too large to permit effective heating of the inner coating.

[32] Marginean et al. U.S. Pat. No. 4,675,705, issued Jun. 23, 1987 ([32] Marginean '705), is cumulative to [29] Marginean '535. The image forming coating has (by weight) a color forming amount (5–25%) of finely divided solid (1–3 micron particle size) colorless or pale colored chromogenic fluoran dye as dye precursor such as 6'-(cyclohexyl-methyl-amino) 3'-methyl-2'-(phenylamino)-spiro (isobenzo-fluoran-1-(3H),9,9(H) xanthene)-3-one. It also has a color developing amount (15–25%) of a finely divided solids combination of benzyl paraben, i.e., benzyl p-hydroxy benzoate, and a halogenated derivative of bisphenol A such as tetrabromo bisphenol A, in a 2–4:1 ratio of benzyl paraben to said halogenated derivative, as color developer, and which at the printing temperature is at least partially fluidizable and capable of a color forming reaction with the dye precursor. The fluoran dyes used as dye precursor (columns 1–2) differ from the fluoran dyes of [30] Yamato. The dye precursor and color developer are distributed in a carrier (binder) of substantially water soluble anionic polysaccharide gum (10–25%) such as gum arabic and a stability enhancing amount (1–10%) of sucrose benzoate. The composition may have additives such as an image stabilizing amount (5–10%) of an image stabilizer such as dimethyl terephthalate, and a filler such as calcium carbonate, titanium dioxide, aluminum hydrate, zinc stearate, waxes and zeolites. A given 1–3 micron particle size solids coating formulation applied to a paper sheet (Example) has, by weight, 7.36% 6'-(cyclohexyl-methyl-amino)-3'-methyl-2'-(phenylamino)-spiro (isobenzo-fluoran-1-(3H),9,9(H) xanthene)-3-one, 16.20% benzyl paraben, 5.42% tetrabromo bisphenol A, 20.20% gum arabic, 1.67% sucrose benzoate, 7.09% dimethyl terephthalate, 26.26% calcium carbonate, 0.92% titanium dioxide, 4.58% aluminum hydrate, 1.66% zinc stearate, 4.76% paraffin wax, and 3.50% zeolite.

[33] Yoshida et al. U.S. Pat. No. 5,061,677, issued Oct. 29, 1991, discloses a one sheet in situ heat reactive dye printing system formed of a receiver sheet protected against plasticizer and oil penetration. It includes a paper substrate of 40–100 micron (0.0016–0.004 inch) thickness, having on its front side an opaque inner layer, an image forming middle layer of a dye precursor and a color developer, and a protective outer layer for contacting the thermal print head and which has high smoothness for increased heat conduction efficiency. A plasticizer and oil penetration preventing back layer is disposed on the back side of the substrate as the opaque inner layer on its front side has an affinity for plasticizers and oils. The protective outer layer has a binder such as PVA, a filler such as calcium carbonate and a lubricant such as zinc stearate. The image forming middle layer has binders such as methyl cellulose and PVA, a dye precursor such as CVL, a color developer such as 4,4'-thiobis (2-methyl phenol), and optionally a thermally fusible substance such as a higher fatty acid amide, e.g., stearic amide, a wax, a higher fatty acid or ester, etc. The opaque inner layer has a binder such styrene-butadiene copolymer latex, with light scattering fine particles, up to 10 micron size, of a styrene-acryl copolymer that imparts opacity to the laminate. The back layer is formed of a binder such as PVA and a filler such as calcium carbonate.

References [34] to [41] concern hybrid or dual printing systems.

[34] Ueyama U.S. Pat. No. 4,688,057, issued Aug. 18, 1987 ([34] Ueyama), discloses a hybrid heat sensitive, simultaneous recording and transferring medium formed as a heat sensitive sheet of a substrate with a conventional heat sensitive color forming coating on its front side and a heat sensitive transferring ink coating on its back side. The sheet is overlaid on a plain paper receiver sheet with the ink coating contacting the paper sheet for printing letters thereon, in the manner of a donor web in contact with a paper sheet in a heat transfer flowable dye printing system. The color forming coating has a dye precursor such as CVL and a color developer such as bisphenol A in a binder such as PVA, starch, and the like, and optionally an auxiliary agent such as clay, talc and the like. The ink coating has three different waxes of mutually differing properties, an extender pigment such as calcium carbonate, clay, barium sulfate, talc and the like, and a coloring agent (ink), all in specified proportions, and optionally a softening agent such as an oil. Apparently, the thermal print head contacts the heat sensitive color forming coating and the heat sensitive ink coating contacts the paper sheet for simultaneously printing images in situ in the color forming coating and duplicate images on the paper sheet by ink transfer from the ink coating. Thus, the print head heat is conducted through the color forming coating and the substrate to transfer ink from the ink coating on the back side of the receiver sheet to the paper sheet.

[35] IBM Technical Disclosure Bulletin, Vol. 24, No. 1A, June 1981 to Kuntzleman et al., proposes coating the front side of a paper sheet with an energizable leuco dye combination, followed by the printing thereof by a write head, and then coating the back side of the sheet with such leuco dye combination, followed by the printing thereof by another write head. The type energizable leuco dye combination is not indicated. This proposal is akin to the initially noted printing systems of [9] Shimizu Jp '765, [10] Teraichi JP '572, [11] Teraichi JP '571 and [12] Murakami JP '688 (English Abstracts), but in view of [34] Ueyama, if a sheet with a heat reactive in situ image forming coating on its front side and also on its back side were printed by a thermal head on one side, the heat from the head would be conducted through the facing coating and the substrate, and also form duplicate images in the coating on the back side.

[36] Kubo et al. U.S. Pat. No. 4,500,896, issued Feb. 19, 1985 ([36] Kubo), discloses a hybrid heat sensitive two-sheet sequential heat transfer flowable dye printing system and heat transfer reactive dye printing system. It is formed of a two-layer transfer sheet and a one layer receiver sheet, to transfer in turn two different colors at two different temperatures from the transfer sheet to the receiver sheet. The transfer sheet is formed of a substrate having on its front side an inner layer of a meltable or sublimable solid ink of a first color and a meltable leuco compound discoloring agent that are melted or activated at a high temperature of 80–150 degrees C., overcoated with an outer layer of a colorless leuco compound of a second color such as CVL or MGL (column 5) as dye precursor that is melted or flow activated at a low temperature of 60–100 degrees C. The high temperature is at least 20 degrees C. higher than the low temperature. The receiver sheet is formed of a substrate having a developer layer of a leuco compound color developer such as bisphenol A, mp 156 degrees C. (column 6), in facing contact with the leuco compound outer layer of the transfer sheet. A thermal head acting on the back side of the transfer sheet operates at the low temperature to conduct heat through the transfer sheet substrate, inner layer and outer layer for melt transfer of the leuco compound from the outer layer to the leuco compound developer in the receiver sheet developer layer to form images of the second color thereon without activating the solid ink or discoloring agent in the inner layer of the transfer sheet. The thermal head then operates at the high temperature to conduct heat through the transfer sheet substrate, inner layer and outer layer for melt transfer of the ink from the inner layer to the receiver sheet developer layer to form images of the first color thereon, and at the same time for melt activation of the discoloring agent in the transfer sheet inner layer to prevent the leuco compound from forming the second color with the color developer in the receiver sheet developer layer.

The solid ink is formed of a fusible substance such as a wax, plus a colorant such as carbon black, crystal violet lactone (colored type), etc. (columns 3–4). The discoloring agent is an alcohol such as stearyl alcohol, propylene glycol, etc., capable when melted of preventing the leuco compound from forming a color with the color developer (columns 4–5). The color developer is a phenolic compound, an organic acid, or an ester or salt thereof, including those of indicated melting points ranging from a low of 50, to a high of 200, degrees C. (columns 6–7). The given layers may have a binder such as PVA, etc. (columns 5–6). The discoloring agent appears to function like the hydroxy benzoic acid esters of [22] Igarashi and [30] Yamato.

[37] Sato U.S. Pat. No. 4,940,993, issued Jul. 10, 1990 ([37] Sato); [38] Hakkaku et al. U.S. Pat. No. 4,962,386, issued Oct. 9, 1990 ([38] Hakkaku '386); and [39] Hakkaku U.S. Pat. No. 5,101,222, issued Mar. 31, 1992 ([39] Hakkaku '222), commonly disclose a hybrid one-sheet in situ heat reactive dye printing system formed of a transparent receiver sheet having transparent heat sensitive layers on its front and back sides for developing three color images by a thermal recording head. Yellow and magenta images are formed sequentially on the front side, and then the sheet is turned upside down to form a cyan image on its back side. The sheet is recorded by the head in three steps, in the first step also undergoing photo fixation of the yellow image by a light source. The sheet has a polyester film substrate, e.g., of PET, coated on its front side by an inner magenta layer that forms an image by high heat level head operation, and an outer light fixable yellow layer that forms an image by low heat level head operation, in turn being fixed by exposure to the light source to stabilize it against further development. The substrate is coated on its back side by a cyan layer that forms an image by high heat level head operation.

In the first step, the sheet moves past the head and light source to form and fix the outer layer yellow image on the front side. The low heat level of the head does not develop the inner magenta layer. In the second step, the sheet returns to the starting point and moves past the head to form the inner layer magenta image, the high heat level of the head not influencing the now stabilized outer yellow layer. Then, the sheet is turned upside down, returns to the starting point, and moves past the head to form the cyan image in the back side layer by operating the head at high heat level. While the outer yellow layer must be low heat reactive to avoid also developing the inner magenta layer, it is not stable at the low heat level of the head, and must be photo fixed before operating the head at the high heat level needed to develop the inner magenta layer.

[40] Washizu et al. U.S. Pat. No. 4,956,251, issued Sep. 11, 1990 ([40] Washizu), discloses a hybrid one-sheet in situ heat reactive dye printing system for sequentially color developing three color layers, i.e., yellow, magenta and cyan, akin to [37] Sato, [38] Hakkaku '386 and [39] Hakkaku '222. As exemplified (columns 20–25), the transparent receiver sheet has a PET film substrate coated on its front side with a high temperature heat reactive inner magenta layer of a magenta dye precursor (leuco dye) and a color developer, and a low temperature heat reactive and photo fixable outer yellow layer of a diazonium compound (diazo dye) and a diazo coupler. The substrate is coated on its back side with a high temperature heat reactive cyan layer of a cyan dye precursor (leuco dye) and a color developer. The outer yellow layer is developed by low temperature print head induced coupling reaction of the diazo dye and diazo coupler, followed by photo-fixing with particular wave length light. The inner magenta layer and the back side cyan layer are developed in sequence thereafter by high temperature print head heat induced reaction, but are not developed at the low temperature used to develop the outer yellow layer. The disclosure sets forth many diazo compounds (columns 6–9), diazo couplers (columns 9–10), leuco compounds including CVL and MGL, as dye precursors (column 5), color developers including phenol compounds, organic acids or metal salts thereof, e.g., of 50–250 degrees C. mp, such as in a weight ratio of 0.3–160 parts color developer per part dye precursor (column 11), layer forming binders such as PVA (columns 14–15), and fillers (columns 12–13).

[41] Kobayashi et al. U.S. Pat. No. 5,115,255, issued May 19, 1992 ([41] Kobayashi), discloses a thermal printer for use exchangeably with a two-sheet heat transfer flowable dye printing system or a one-sheet in situ heat reactive dye printing system. The two-sheet system of an ink bearing donor web as transfer sheet and plain paper as receiver sheet is physically replaced in the printer by the one-sheet system of a receiver sheet having a heat reactive dye color image layer (column 4), and the controls are reset (column 6), for one-sheet in situ reactive dye printing.

This most recent hybrid teaching, [41] Kobayashi, confirms the lack of availability of a two sided thermal printing system providing for both the receiving of a heat transfer printed image on one side of a sheet and the in situ printing of a different image on the other side of the same sheet.

As is clear from the foregoing, two differing systems of thermal printing currently exist for printing images on recording media such as paper sheets. One system is the one sheet in situ heat reactive thermal printing system, or simply the direct dye development thermal printing system, and the other system is the two-sheet heat transfer flowable dye thermal printing system, or simply the dye transfer thermal printing system.

In practice, in the direct dye development thermal printing system, a sheet of thermally reactive material as receiver sheet is conducted past a thermal print head to generate images directly therein by modulating (selectively energizing) the head, with respect to energizing time (pulse width) and heat level (Joule heat) per image pixel element, or simply pixel (e.g., of 0.003 inch pixel height and 0.003 inch pixel width, aspect ratio). In the dye transfer thermal printing system, the head is similarly modulated to transfer dye from a dye bearing carrier (dye transfer web, donor web) as transfer sheet to a dye receiving medium as receiver sheet, e.g., a paper sheet. These print heads are typically formed of a plurality of resistor elements such that when a given resistor element is energized it produces heat. In the direct thermal printing system, the heat causes direct formation of an in situ image in the sheet of thermally reactive material. In the dye transfer thermal printing system, the heat causes transfer of dye from the dye transfer web to the dye receiving sheet. In the printers of these systems, a rotating platen and other conveying means are normally used to move the thermally reactive sheet, or the dye receiving sheet together with the dye transfer web, past the head during printing. Associated motors are operated in such manner that the head modulation, platen rotation and operation of the other conveying means produce a series of pixel elements of correct aspect ratio on the given sheet.

More particularly, the direct thermal printing system uses a thermally reactive sheet having a coating of heat activated dye material particles that directly release or change pigmentation in situ on applying heat thereto, e.g., to change or develop directly in situ a leuco dye from colorless to color state. Coatings of this type are used commercially in facsimile systems (FAX machines). For instance, coated paper (FAX paper) is fed through a printing nip between a thermal print head and a platen, usually under slight compression, and the head is modulated as the FAX paper advances through the nip to form an image directly in situ by selective thermal activation of the dye material particles in the coating. These FAX papers typically, but not necessarily, are below 0.002 inch thickness (including the dye material coating) to permit intimate contact at low nip compression between the head and thermally activated dye material coating on the paper for efficient heat transfer to achieve direct color image development.

In the dye transfer thermal printing system, a dye transfer web bears the pigmentation, and the dye is selectively transferred from the web to a recording receiver sheet, using a thermal print head similar in construction to that of the direct thermal printing system, and an associated platen forming a printing nip with the head, typically under slight compression. The dye carried on the transfer web, which may be a wax based pigment or a heat diffusible (sublimable) dye, is selectively transferred to the receiver sheet to form the image by controlled modulation of the head.

In the wax based system, which is comparatively inexpensive and in which the print head operates at lower thermal levels for transfer of the wax based dye, plain (uncoated) paper of about 0.002 to 0.003 inch thickness is used. However, the transferred images are of comparatively poor clarity due to the uneven surface character of the uncoated paper on which the wax based dye is deposited. This is traceable to the surface discontinuities of plain paper. For maximum clarity and uniformity of the transferred images, the nip pressure must be kept uniform, and the receiver sheet recording surface must be uniformly smooth.

In the diffusible dye system, dye is deposited from a dye transfer web onto a special dye receiving coating disposed on a substantially thicker member as receiver sheet, e.g., coated paper, of about 0.005 to 0.009 inch thickness (including the coating). The density or darkness of the printed color dye is a function of the heat energy delivered from the individual resistor elements of the thermal head to the dye transfer web as transfer sheet. Thermal dye transfer printers of the diffusible dye system type offer the advantage of true "continuous tone" dye density transfer. This is achieved by selectively varying the energy applied to each resistor element of the head, to provide a variable dye density image pixel in the receiver sheet coating.

The dye diffusion process creates a more stable image but requires a substantially greater amount of heat to accomplish diffusion transfer than is needed for other types of thermal printing. The receiver sheet for the dye diffusion process may have several layers. Typically, a paper material substrate is coated on both sides with a layer of soft polymeric material such as polyethylene or polypropylene. The dye receiving side of the soft layer coated substrate is typically coated with a water based antistatic agent to permit solvent coating thereon of an outer dye receiving layer providing a dye receiving surface. The dye receiving layer is typically formed of high heat deflection material such as polycarbonate, solvent coated onto the soft layer on one side of the substrate, while the soft layer on the opposite side of the substrate remains exposed.

The multilayer composite formed with coatings on both sides of the substrate, is generally sufficient in thickness to withstand the higher level of heat required for thermal transfer of the diffusible dye from the web to the dye receiving layer on one side of the substrate. The soft layer on the opposite side of the substrate contributes to the stability of the composite and its ability to withstand the higher heat level needed for dye transfer.

It is desirable to provide a two sided thermal printing system formed of a sheet substrate having a front side coated with a heat transfer flowable dye receiving coating serving as a receiver sheet for thermal printer heat transferred first desired color images, transferred from an extraneous dye transfer source in a transfer printing step, and a back side coated with a heat sensitive, in situ heat reactive dye coating serving as a counterpart receiver sheet for thermal printer formed, in situ, second desired color images, unrelated to the transferred first color images, and formed by heat activation in an in situ printing step, such that the reactive dye coating is not activated to form in situ images under the attendant heat applied during the transfer printing step.

In particular, it is desirable to print on both sides of a sheet by dye transfer thermal printing on the front side thereof, e.g., using a multicolor transfer web having a successive series of different color dye areas for repeated thermal transfer printing of graphic color images on a same area on the front side, and by direct thermal printing on the opposing back side thereof, e.g., using a heat activated dye coating on the back side for printing text information thereon, without activating the dye coating on the back side during dye transfer printing on the front side.

SUMMARY OF THE INVENTION

The drawbacks of the prior art have been obviated by providing a two sided thermal printing system in accordance with the present invention which contemplates a sheet specially coated on both sides for two sided thermal printing thereof. This system permits printing of both sides of the sheet by way of dye transfer thermal printing on a dye receiving coating on a first side thereof by thermal printing means (a thermal print head), and direct thermal printing in a heat activated dye coating on an opposing second side thereof by thermal printing means (the same or a different thermal print head), while preventing activation of the dye coating on the second side during dye transfer printing on the first side.

For example, the dye transfer thermal printing may be effected using a multicolor dye transfer web with a successive series of different color dye areas for repeated thermal transfer of graphic color images on a same area on the first side of the sheet, and the direct thermal printing may be effected using a heat activated dye coating on the second side of the sheet for printing text thereon.

The makeup of the coated sheet must be such that the sheet portion exclusive of the heat activated dye coating on the second side, possesses sufficient thickness and composite thermal insulation properties (thermal resistance) to prevent activation of the dye material in the coating on the second side during dye transfer thermal printing on the first side.

Accordingly, a coated sheet for two sided thermal printing is contemplated, comprising a thermally insulating substrate, such as paper or a polymer film, the latter optionally in the form of a minute void filled polymer foam structure, with the substrate defining opposed first and second surfaces having corresponding first and second coatings thereon, i.e., on its opposing sides.

The first surface of the substrate has a dye receiving, thermally insulating first coating for forming a dye transfer image thereon upon selective thermal transfer of heat flowable dye thereto from an extraneous source, such as a dye transfer web (donor web), by thermal printing means in a transfer printing step. The first coating defines a third surface. The first coating may comprise an inner layer of a compliant polymer such as polyethylene or polypropylene, overcoated with an outer layer of a substantially non compliant, heat deflecting, transfer dye receptive polymer such as polycarbonate, for forming the dye transfer image thereon, with the outer layer defining the third surface.

The second surface of the substrate has a second coating containing heat activated dye material for forming, in situ, a dye image upon selective applying of heat directly thereto by thermal printing means in an in situ printing step. The second coating defines a fourth surface remote from the third surface. The heat activated dye material is normally colorless and changes to a color state in situ upon heat activation. The second coating may comprise a binder matrix containing heat activated dye material comprising a mixture of particles of a normally colorless dye precursor and particles of a color developer therefor which upon heat activation undergo a color developing reaction to change the dye precursor to a color state. The matrix may be formed of a binder such as polyvinyl alcohol (PVA), starch, etc.

The sheet defines in cross section a composite portion between the third surface and second surface, i.e., including the first coating and substrate, with a sufficient thickness and a sufficient thermal resistance for inhibiting heat transfer therethrough from the third surface to the second surface during the transfer printing step to prevent activation of the dye material in the second coating. The composite portion may have a thickness at least three to six times that of the second coating.

Typically, the substrate has a thickness of about 0.00200 to 0.00500 inch (27–41 microns), the first coating has a thickness of about 0.00105 to 0.00160 inch (50–125 microns), and the second coating has a thickness of about 0.00050 to 0.00100 inch (13–26 microns), so that the composite portion is about 0.00305 to 0.00660 inch (77–166 microns) thick, and the sheet overall is about 0.00355 to 0.00760 inch (90–192 microns) thick.

In particular, the heat activated dye material in the second coating is activated at a given activation temperature, and the thermal resistance of the composite portion is the reciprocal of the corresponding mean thermal conductivity of the composite portion. The thickness and thermal resistance of the composite portion are such that the product of the heat transferred through the composite portion from the third surface to the second surface during the transfer printing step, times the composite portion thickness, times the mean thermal conductivity of the composite portion, constitutes a value below the activation temperature of the heat activated dye material.

This invention also contemplates the corresponding method for two sided thermal printing of the above described coated sheet. The method comprises carrying out the transfer printing step to form a dye transfer image in the first coating, and the in situ printing step to form, in situ, a dye image in the second coating, such that heat transfer through the composite portion from the third surface to the second surface is inhibited during the transfer printing step to prevent activation of the dye material in the second coating. The transfer printing step may be carried out before or after the in situ printing step.

The invention will be more readily understood from the following detailed description taken with the accompanying drawings and claims.

It is noted that the drawings are not to scale, some portions being shown exaggerated to make the drawings easier to understand.

DETAILED DESCRIPTION

Figure 1:
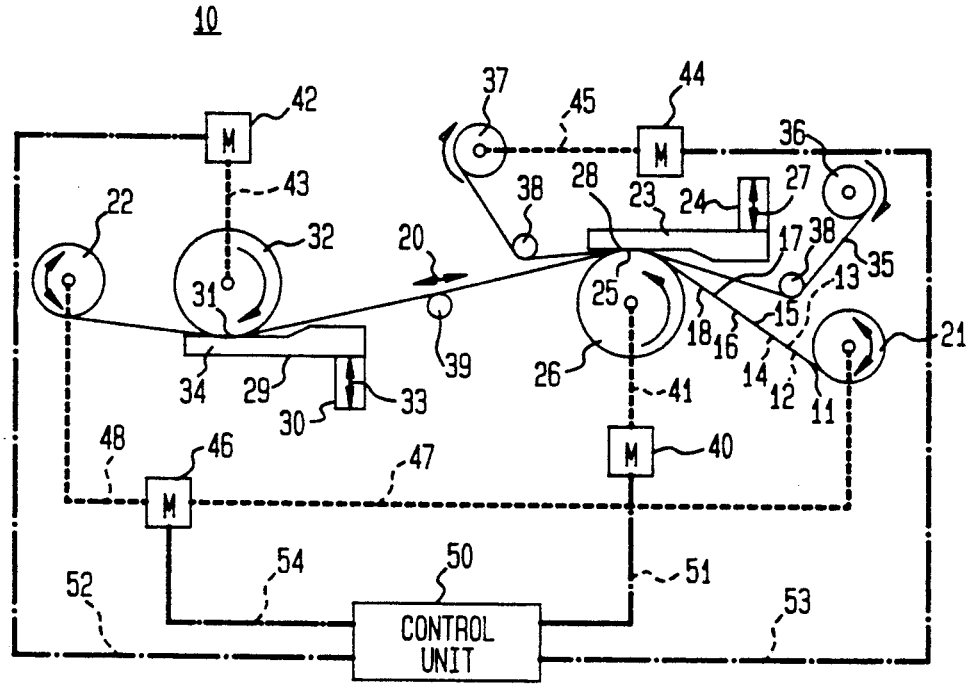
FIG. 1 is a schematic view of an apparatus for two sided thermal printing of a coated sheet in accordance with one embodiment of the invention.

Referring now to FIG. 1, there is shown a thermal printing apparatus 10 for two sided thermal printing of a coated sheet 11 (receiver sheet) in accordance with an embodiment of the invention. The sheet 11 is formed of a substrate 12 defining opposed first and second surfaces 13 and 14 correspondingly having first and second coatings 15 and 16 defining exposed third and fourth surfaces 17 and 18, respectively, i.e., on the opposed sides of the sheet.

Apparatus 10 comprises a printing path 20 (indicated by an arrow in FIG. 1), sheet feed and takeup reels 21 and 22, a first printer head 23, a first solenoid 24, a first point 25, a first platen 26, a first solenoid path 27 (indicated by an arrow in FIG. 1), a first printing nip 28, a second printer head 29, a second solenoid 30, a second point 31, a second platen 32, a second solenoid path 33 (indicated by an arrow in FIG. 1), a second printing nip 34, a dye transfer web (donor web) 35, web feed and takeup spools 36 and 37, web guide rolls 38, a sheet guide roll 39, a first platen motor 40 and drive linkage 41, a second platen motor 42 and drive linkage 43, a web motor 44 and drive linkage 45, a sheet motor 46 and feed and takeup drive linkages 47 and 48, a control unit 50 and control lines 51, 52, 53 and 54.

Sheet 11 is mounted on feed reel 21 and takeup reel 22 to extend therebetween for travel along printing path 20 past first point 25 and second point 31 to effect desired printing operations (steps) During such travel, the third surface 17 defined by first coating 15 on first surface 13 of substrate 12 faces in a direction toward first point 25, while the fourth surface 18 defined by second coating 16 on second surface 14 of substrate 12 faces in an opposite direction toward second point 31.

First head 23 and second head 29 are conventional thermal printing heads, which may be identical, each having a plurality of resistor elements (not shown) energizable to generate images on a responsive imaging material, in this case on sheet 11.

First head 23 is located at first point 25 on path 20 and is connected to first solenoid 24 for movement along first solenoid path 27 from a spaced position to a contact position relative to first platen 26. In the contact position, first head 23 forms first printing nip 28 with first platen 26, typically under slight compression. First platen 26 is mounted for rotation about a stationary axis in clockwise or counterclockwise direction under the action of the reversible first platen motor 40 via first platen drive linkage 41, in conventional manner.

Second head 29 is located at second point 31 on path 20 in opposed relation to first head 23 and is connected to second solenoid 30 for movement along second solenoid path 33 from a spaced position to a contact position relative to second platen 32. In the contact position, second head 29 forms second printing nip 34 with second platen 32, typically under slight compression. Second platen 32 is mounted for rotation about a stationary axis in clockwise or counterclockwise direction under the action of the reversible second platen motor 42 via second platen drive linkage 43, in conventional manner.

Dye transfer web 35 is fed from feed spool 36 and received on take-up spool 37, after passing via the spaced guide rolls 38 along path 20 through first nip 28, under the action of web motor 44 via web takeup spool drive linkage 45, in conventional manner.

Web 35 is typically a multicolor web having a series of successively repeating areas of different color dyes, such as the three colors: cyan, magenta and yellow, e.g., in the sequence: cyan, magenta, yellow, cyan, magenta, yellow, etc., or the four colors: cyan, magenta, yellow and black, e.g., in the sequence: cyan, magenta, yellow, black, cyan, magenta, yellow, black, etc., for successive cycle transfer printing via first head 23 on a same given area of third surface 17 of first coating 15 of successive web colors in a first printing operation (first step).

The dyes of web 35 are typically meltable or diffusible (sublimable) dyes that transfer as heat flowable dyes therefrom to first coating 15 by the action of heat in conventional manner.

Examples of such sublimable dyes for web 35 include those disclosed in [14] Long (U.S. Pat. No. 4,804,977), the disclosure of which is incorporated herein by reference, to wit:

anthraquinone dyes, e.g., Sumikalon Violet RS (product of Sumitomo Chemical Co., Ltd.), Dianix Fast Violet 3R-FS (product of Mitsubishi Chemical Industries, Ltd.), and Kayalon Polyol Brilliant Blue N-BGM and KST Black 146 (products of Nippon Kayaku Co., Ltd.);

azo dyes such as Kayalon Polyol Brilliant Blue BM, Kayalon Polyol Brilliant Dark blue 2BM, and KST Black KR (products of Nippon Kayaku Co., Ltd.), Sumickaron Diazo Black 5G (product of sumitomo Chemical Co., Ltd.), and Mkitazol Black 5GH (product of Mitsui Toatsu Chemicals Inc.);

direct dyes such as Direct Dark Green B (product of Mitsubishi Chemical Industries, Ltd.), and Direct Brown M and Direct Fast Black D (products of Nippon Kayaku Co., Ltd.);

acid dyes such as Kayanol Milling Cyanine 5R (product of Nippon Kayaku Co., Ltd.);

basic dyes such as Sumicacryl Blue 6G (product of Sumitomo Chemical Co., Ltd.), and Aizen Malachite Green (product of Hodogaya Chemical Co., Ltd.); or any of the dyes disclosed in [13] Hotta (U.S. Pat. No. 4,541,830), the disclosure of which is incorporated herein by reference.

The dye of web 35 may also be a known wax based dye that melts and flow transfers at a lower temperature than sublimable dyes.

As used herein, a "heat flowable dye" such as that provided on web 35 means a dye that is heat fluidized, i.e., heat transferrable in fluid form, e.g., in liquid (melted, molten) or gaseous (vaporized, sublimed) diffusible (fluidized) form, during the transfer printing step (first step).

Sheet 11 is arranged by feed reel 21 and takeup reel 22, with the aid of one or more guide rolls 39, for travel along path 20 through first nip 28 and second nip 34 in forward and reverse directions, under the action of the reversible sheet motor 46 via sheet feed reel drive linkage 47 and sheet takeup reel drive linkage 48, in conventional manner. During travel of sheet 11, third surface 17 of first coating 15 faces first head 23 at first nip 28, with web 35 interposed therebetween, while fourth surface 18 of second coating 16 faces second head 29 at second nip 34.

Control unit 50 is connected by control line 51 to first platen motor 40, by control line 52 to second platen motor 42, by control line 53 to web motor 44, and by control line 54 to sheet motor 46. Unit 50 is also connected (by means not shown) to first solenoid 24 and second solenoid 30. Unit 50 is of conventional type, e.g., having a programmed microprocessor, for control of first platen motor 40, second platen motor 42 and sheet motor 46 for concordant operation to convey sheet Il via first platen 26, second platen 32, sheet feed reel 21 and sheet takeup reel 22 in a forward direction from first point 25 toward second point 31 during a printing step at either first head 23 or second head 29, or in a reverse direction from second point 31 toward first point 25 for reregistering a given area of third surface 17 of first coating 15 of sheet 11 for repeated cycle printing at first head 23 with a further dye area of web 35, in conventional manner.

Unit 50 also controls web motor 44 for concordant operation with first platen motor 40, second platen motor 42 and sheet motor 46 when sheet 11 is conveyed in forward direction from first point 25 toward second point 31 during a first printing step using first head 23, to move web 35 and sheet 11 simultaneously at uniform speed in that direction. Unit 50 deactivates web motor 44 when sheet 11 is conveyed in reverse direction for reregistering a given area thereof with first head 23, as above described.

When first head 23 is used for a first printing step via web 35 on first coating 15 of sheet 11, it is moved along first solenoid path 27 by first solenoid 24 from spaced position to contact position with first platen 26 at first nip 28, and is otherwise retracted to spaced position, under control of unit 50. When second head 29 is used for a second printing step via direct thermal applying of heat to second coating 16 on the opposite side of sheet 11, it is moved along second solenoid path 33 by second solenoid 30 from spaced position to contact position with second platen 32 at second nip 34, and is otherwise retracted to spaced position, under control of unit 50.

Unit 50 controls first head 23 and second head 29 for independent operation to effect a first printing step or a cycle thereof on first coating 15 by web 35 and first head 23, either before, during or after a second printing step on second coating 16 by second head 29, as desired.

In a first printing step at first point 25, initially first head 23 is in spaced position, and web 35 is advanced by rotation of takeup spool 37 under the action of web motor 44 to align relative to first nip 28 the next web color area to be printed. At about the same time, sheet 11 is moved by common rotation of first platen 26, second platen 32, sheet feed reel 21 and sheet takeup reel 22 under the action of first platen motor 40, second platen motor 42 and sheet motor 46 for alignment with first head 23 to register a given area on first coating 15 to be printed in respective cycles with successive color areas on web 35.

During a first printing cycle using first head 23, after first head 23 is moved by first solenoid 24 to contact position, web 35 passes through first nip 28 adjacent head 23 and sheet 11 passes through first nip 28 adjacent first platen 26, so that a given area of first coating 15 to be printed coincides with a given color area on web 35. The printing action of first head 23 causes heat transfer of thermally diffusible dye, located in the given color area on web 35, to selective areas of sheet 11 to form, e.g., graphic, images thereon of that color, per known technique.

As sheet reels 21 and 22, web spools 36 and 37, and platens 26 and 32, all rotate at concordant peripheral speeds to convey web 35 and sheet 11 at the same linear speed in a printing cycle at first head 23, web 35 and sheet 11 travel in unison in a forward printing direction from first point 25 toward second point 31 through first nip 28, i.e., from the upstream entrance side to the downstream exit side thereof, to effect thermal printing of the images of the given web color in the cycle under the control of unit 50.

Since the operation usually contemplates repeated printing on the same area of first coating 15 of sheet 11 to imprint images thereon of each of the multiple series of colors from web 35, at this point first head 23 is retracted to spaced position, and web 35 is advanced by rotation of web takeup spool 37 via web motor 44, to align the next successive color area with first nip 28 under the control of unit 50. On the other hand, sheet 11 must be moved in reverse direction, i.e., in a direction from the exit side to the entrance side of first nip 28, until its same given area being printed is again at the starting position for effecting the next printing cycle of the first printing step by first head 23.

For this purpose, unit 50 controls the operation of first platen motor 40, second platen motor 42 and sheet motor 46 to move sheet 11 in reverse direction from second point 31 toward first point 25 via first platen 26, second platen 32, sheet feed reel 21 and sheet takeup reel 22 until its same given area being printed is again aligned with first head 23 at the starting position to effect the next printing cycle. The initial forward alignment and printing cycle steps at first head 23 are followed by reverse alignment and repeated forward printing cycle steps for each remaining color to be printed on sheet 11 at first head 23. Then, sheet 11 is advanced under the control of unit 50 to align the next area on first coating 15 to be printed at first head 23.

Before or after printing cycle operations are effected with first head 23 at first point 25 on a given area of third surface 17 of first coating 15 of sheet 11, a separate second printing step may be effected with second head 29 at second point 31 on fourth surface 18 of second coating 16 at the same area of sheet 11 as that printed on the opposite side at first head 23, as above stated. Alternatively, the second printing step may be effected on a downstream area of sheet 11 at the same time as the first printing step is being effected on an upstream area of sheet 11.

To effect a second printing step, second head 29 is moved via second solenoid 30 from spaced position to contact position with second platen 32 at second nip 34. Then, as sheet 11 is moved in the forward printing direction from first point 25 toward second point 31 at uniform speed, in the manner earlier described, second head 29 is selectively energized to apply heat to fourth surface 18 on second coating 16. This activates the dye material in second coating 16, causing the dye material to change from colorless to color state in situ according to its given activation temperature.

Head 23 and head 29 individually operate at a selective head temperature controlled by unit 50 which is effective for carrying out the first printing step and second printing step, respectively. Each of heads 23 and 29 is typically operated at a head temperature of about 200 to 250 degrees C. Accordingly, the heat activated dye material in second coating 16 has a predetermined activation temperature of correspondingly about 200 to 250 degrees C.

Conventional conveying and sensing means (not shown) may be provided to assist travel of sheet 11 for precise registering and reregistering of a given area thereof with first head 23 and/or second head 29 at the desired starting position before a given printing step, and to pull it in the forward direction through first nip 28 and/or second nip 34 during a printing cycle of a first printing step via first head 23 and/or during a second printing step via second head 29, as the case may be.

Figure 2:
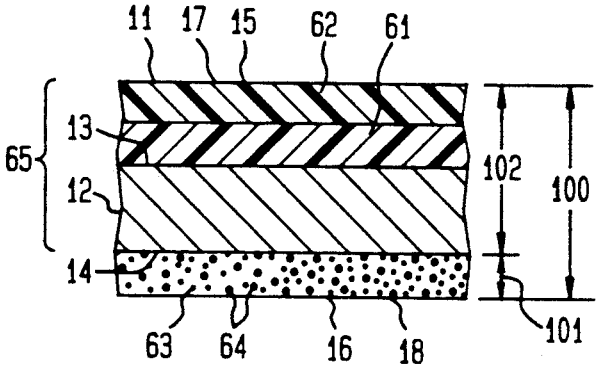
FIG. 2 is a schematic sectional view showing the various parts making up the coated sheet shown in FIG. 1.

Referring now to FIG. 2, sheet 11 is shown in sectional view with first coating 15 on first surface 13 of substrate 12 formed of an inner layer 61 overcoated with an outer layer 62 which defines third surface 17, and with second coating 16 on second surface 14 of substrate 12 formed of a binder matrix 63. Matrix 63 contains a dispersion of conventional heat activated dye material particles 64 distributed uniformly therein. Sheet 11 has an overall thickness 100 (L). Second coating 16 has a thickness 101 (L1) between second surface 14 of substrate 12 and fourth surface 18 of second coating 16. First coating 15 and substrate 12 form a composite portion 65 having a thickness 102 (L2) between third surface 17 of first coating 15 and second surface 14 of substrate 12. Thus, the total thickness L of sheet 11 minus the thickness L1 of second coating 16 equals the thickness L2 of composite portion 65.

Substrate 13 may be formed of suitable thermally insulating material such as paper as shown, or a polymer film such as a transparent polyethylene terephthalate film, e.g. MYLAR (duPont).

Inner layer 61 of first coating 15 may be formed of suitable thermally insulating, compliant supporting material such as a compliant (pliable, resilient, soft) polymer such as an olefin, e.g., polyethylene or polypropylene. Outer layer 62 of first coating 15 may be formed of suitable thermally insulating, substantially non-compliant, heat deflecting, transfer dye receptive material such as a non-compliant (rigid, stiff, hard) polymer, e.g. polycarbonate, to receive a transfer image thereon.

As sheet 11 undergoes compression at nips 28 and 34, inner layer 61 must be compliant to enable non-compliant outer layer 62 to accommodate pressure variations on travel of sheet 11 through such nips during printing to attain overall pressure uniformity and resultant uniformity of the clarity of the dye transfer images.

On the other hand, outer layer 62 must be non-compliant to permit efficient dye transfer from web 35 thereto and to enable the dye to be absorbed and retained therein to provide a bright hue and prevent subsequent dye wandering. Outer layer 62 desirably has a uniformly smooth surface constituting third surface 17 to enhance the clarity uniformity of the dye images printed thereon. Outer layer 62 is formed of high heat deflection material such as polycarbonate to withstand the high level of heat applied thereto by head 23 in the first printing step, and to inhibit transfer of such heat internally through sheet 11 to second coating 16.

The insulating materials used to form substrate 12, inner layer 61 and outer layer 62 have pronounced thermal resistance to provide composite portion 65 with a predetermined mean thermal resistance, which is defined as the reciprocal of the corresponding mean thermal conductivity thereof.

Inner layer 61 and outer layer 62 of first coating 15 are formed On first surface 13 of substrate 12 in known manner.

Heat activated dye material particles 64 may comprise a conventional heat sensitive color forming particulate composition of particles of a colorless dye (leuco dye) such as lactone series dyes, e.g., crystal violet lactone (CVL), lactam series dyes, fluoran series dyes, spiropyran series dyes and the like, as dye precursor, admixed with particles of a color forming agent such as phenol compounds, e.g., bisphenol A, organic acids or salts thereof, and the like, as color developer.

Suitable dye precursors are disclosed in [18] Sullivan (U.S. Pat. No. 3,244,548), [19] Farnham '550 (U.S. Pat. No. 3,244,550), [21] Farnham '229 (U.S. Pat. No. 3,560,229), [27] Oeda (U.S. Pat. No. 4,168,845), [28] Marginean '264 (U.S. Pat. No. 4,287,264), [29] Marginean '535 (U.S. Pat. No. 4,289,535), [36 Kubo (U.S. Pat. No. 4,500,896), and [40] Washizu (U.S. Pat. No. 4,956,251), the disclosure of each of which is incorporated herein by reference.

Suitable color developers are disclosed in [24] Baum (U.S. Pat. No. 3,539,375), the disclosure of which is incorporated herein by reference, and in said [18] Sullivan, [19] Farnham '550, [28] Marginean '264, [29] Marginean '535, [36] Kubo, and [40] Washizu. Phenol compounds of stated melting point are listed in said [24] Baum, and phenol compounds and organic acids of stated melting point are listed in said [36] Kubo. The color developer melting point generally equals the activation temperature.

Besides the combination of a colorless leuco dye with a phenolic compound, organic acid or salt thereof, the combination of a diazo dye and a diazo coupler may be used, provided that a permanent color forming diazo coupling reaction occurs at the activation temperature of the second printing step (in situ printing step), which reaction does not require photo fixing, and does not occur under the heat applied to sheet 11 in the first printing step (thermal transfer printing step).

Matrix 63 may be formed of a binder such as PVA, starch, gum arabic (e.g., optionally together with sucrose benzoate), gum karaya, water soluble alginates, agar and agaroid gums, carrageen, carrageenan, methyl cellulose, carboxy methyl cellulose, hydroxy ethyl cellulose, hydroxy propyl cellulose, casein, and the like, and mixtures thereof. Suitable binders are disclosed in [32] Marginean '705, the disclosure of which is incorporated herein by reference, and in said [27] Oeda, [28] Marginean '264, [29] Marginean '535, [36] Kobo, and [40] Washizu.

Matrix 63 may also be formed of a heat resistant polymer such as vinyl acetate-maleic anhydride copolymer, styrene-maleic anhydride copolymer, styrene-butadiene copolymer, and the like. Suitable matrix polymers are disclosed in [31] Wiklof (U.S. Pat. No. 4,604,635), the disclosure of which is incorporated herein by reference, and in said [27] Oeda, [36] Kobo, and [40] Washizu.

Matrix 63 may contain conventional auxiliary agents, including fillers such as aluminum hydroxide (aluminum hydrate), calcium carbonate, titanium dioxide, silica, talc, kaolin (clay), zeolites, zinc stearate, waxes, and the like, and mixtures thereof; image stabilizers such as dimethyl terephthalate; anti-sticking agents such as butyl zimate, i.e., zinc di-n-butyl thiocarbamate; pressure sensitivity inhibiting agents such as a micronized polyolefin, e.g., polyethylene, or micronized modified (fluorinated) polyolefin, e.g. fluorinated polyethylene, having a molecular weight of about 1,000 to 2,000 and a melting point of about 240–700 degrees F. (116–371 degrees C.); and like type agents.

Suitable fillers are disclosed in said [31] Wiklof, [32] Marginean '705, and [36] Kubo; suitable image stabilizers are disclosed in said [32] Marginean '705; suitable anti-sticking agents are disclosed in said [28] Marginean '264 and [29] Marginean '535; and suitable pressure sensitivity inhibiting agents are disclosed in said [29] Marginean '535.

Second coating 16 containing heat activated dye material particles 64 is formed on second surface 14 of substrate 12 in known manner. Second coating 16 is typically a formulation as used on facsimile paper for facsimile machines (FAX machines).

The problem in attempting to provide for thermal printing of both sides of a coated sheet having a thermal transfer dye receiving coating on one side, and a heat activated in situ direct development dye coating on the other side, is that the heat imparted to the dye receiving coating for transfer of dye from a dye web thereto flows through the sheet from the dye receiving coating to the heat activated dye coating. This can cause undesired incipient in situ development of the heat activated dye material on the second side of the coated sheet during thermal transfer printing of the first side of the sheet.

In accordance with the present invention, this undesired heat transfer is avoided by providing composite portion 65, containing substrate 12 plus inner layer 61 and outer layer 62 of first coating 15, with a sufficient composite thickness L2, and providing substrate 12, inner layer 61 and outer layer 62 of corresponding insulating materials with sufficient thermal resistance, to inhibit heat transfer through composite portion 65. Specifically, composite portion 65 must have a sufficient composite thickness L2 between third surface 17 and second surface 14 and a sufficient composite thermal resistance to inhibit heat transfer therethrough from third surface 17 to second surface 14 during the first printing step via first head 23 to prevent activation of dye particles 64 in matrix 63 of second coating 16.

By providing composite portion 65 with a sufficient composite thickness L2 and a sufficient composite thermal resistance, the first printing step may be effected via first head 23 under the control of unit 50 according to the relation (I):

$$Q \times L2 \times K < T \quad (I)$$

wherein:

Q is the printing heat transferred by first head 23 to sheet 11,

L2 is the thickness of composite portion 65 (i.e., the overall thickness L of sheet 11 minus the thickness L1 of second coating 16 containing the heat activated dye particles 64), K is the mean thermal conductivity of composite portion 65, and T is the temperature required to activate dye particles 64.

Thus, the product of the heat Q transferred through composite portion 65 from third surface 17 to second surface 14 during the first printing step, times the thickness L2 of composite portion 65, times the mean thermal conductivity K of composite portion 65, constitutes a numerical value which is below the activation temperature T of dye material particles 64 in second coating 16.

For example, if head 23 and head 29 are both operated at 250 degrees C., with the activation temperature T of dye material particles 64 also being 250 degrees C., the product of the heat Q transferred through composite portion 65 from third surface 17 to second surface 14 in the first printing step, times the thickness L2 of composite portion 65, times the mean thermal conductivity K of composite portion 65, must be a value below 250.

If head 23 is operated at 250 degrees C. and head 29 is operated at 200 degrees C., with the activation temperature T of dye material particles 64 also being 200 degrees C., the product of the heat Q transferred in the first printing step, times the thickness L2, times the mean thermal conductivity K, must be a value below 200. In this case, thickness L2 must be increased and/or mean thermal conductivity K decreased for sufficiently preventing heat flow through composite portion 65 to offset the higher operating temperature of head 23 in the first printing step. This may be achieved by increasing the thickness and/or thermal resistance of substrate 12, inner layer 61 and/or outer layer 62, by suitable selection of the insulation properties and/or thickness of the materials used to provide these parts of sheet 11.

On the other hand, where head 23 is operated at 200 degrees C., e.g., using a wax based dye material melting at a lower temperature than that needed to transfer a sublimable dye, and head 29 is operated in the second step at 250 degrees C. for dye material particles 64 whose activation temperature T is 250 degrees C., the product of the transferred heat Q in the first printing step, times the thickness L2, times the mean thermal conductivity K, is perforce a value below 250. In this case, thickness L2 and mean thermal conductivity K need only be sufficient for concordantly preventing heat flow through composite portion 65 at the lower operating temperature of head 23 in the first printing step. This may be achieved by less stringent insulation properties and/or reduced thicknesses of the materials used to provide substrate 12, inner layer 61 and/or outer layer 62 of sheet 11.

Preferably, substrate 12 is about 0.00200 to 0.00500 inch (50–125 microns) thick, first coating 15 is about 0.00105 to 0.00160 inch (27–41 microns) thick, and second coating 16 is about 0.00050 to 0.00100 inch (13–26 microns) thick (L1), so that composite portion 65 is about 0.00305 to 0.00660 inch (77–166 microns) thick (L2), and sheet 11 overall is about 0.00355 to 0.00760 inch (90–192 microns) thick (L). The 0.00105 to 0.00160 inch thick first coating 15 may include an inner layer 61 about 0.00065–0.00110 inch (17–28 microns) thick and an outer layer 62 about 0.00040 to 0.00050 inch (10–13 microns) thick.

Sheet 11 may have a conventional type layer (not shown) between substrate 12 and first coating 15, between substrate 12 and second coating 16, and/or as an anti-stick layer on second coating 16 to prevent sticking thereof to a print head, e.g., a silicone resin anti-stick layer as disclosed in said [31] Wiklof.

In any case, in typical in situ direct thermal printing, the printer resistor elements print image pixels of about 0.003 by 0.003 inch area in the image forming coating without image spread laterally beyond the pixel area as the resistor element heat is localized within the 0.003 inch applied range. However, as the receiver sheet is typically less than 0.002 inch thick, the heat travels completely therethrough at the same time as it travels along the image forming coating within the 0.003 inch lateral spread range. This heat is intensified in the printing nip due to compression of the receiver sheet between the print head and platen. Subjecting the other side of the receiver sheet to thermal transfer printing would have the same heat transfer effect as the heat applied to a donor web for flow transfer therefrom of dye to the other side of the receiver sheet would travel in the reverse direction through the receiver sheet and activate the dye material, forming images or at least fog in the image forming coating.

According to the invention, sheet 11 overcomes this problem while retaining a relatively small overall thickness L of about 0.00355 to 0.00760 inch (90–192 microns), by providing a composite portion 65 of a thickness L2, e.g., of about 0.00305 to 0.0066 inch (77-166 microns), which with the inherent thermal resistance of composite portion 65 inhibits heat transfer therethrough during the transfer printing step, and thus prevents activation of dye material particles 64 in the image forming second coating 16.

This permits transfer printing to be effected at the high temperature normally used for efficient sublimation dye transfer printing on first coating 15, instead of being limited to dyes that melt or sublime at low temperature such as below 100 degrees C. as disclosed in said [13] Hotta. The activation temperature of dye material particles 64 may be selected by using a color developer, e.g., a phenolic compound, having a melting point (activation temperature) above the heat value determined per relation (I).

Dye material particles 64 and matrix 63 may comprise the specific formulations disclosed in said [28] Marginean '264, [29] Marginean '535, and [32] Marginean '705.

In an illustrative embodiment, second coating 16 may contain particles of a monochrome, e.g. black, dye precursor to print text on that side of sheet 11, and web 35 may be a multicolor web for transfer in turn of each of a series of different dye colors, e.g., cyan, magenta, yellow and black, onto the same given area of first coating 15 on the other side of sheet 11, on registering that same area with head 23 each time to print each successive color on first coating 15, to form a graphic image, in known manner. This permits a transparent, e.g., polymer film, substrate 12 with transparent first and second coatings 15 and 16 (not shown), to be printed with graphic images in one location on first coating 15 on one side of sheet 11 and explanatory text images in a different location in second coating 16 on the other side of sheet 11.

Of course, sheet 11 may be printed with the same print head by printing one side, e.g., first coating 15, then turning sheet 11 over and printing the other side, e.g., second coating 16.

Figure 3:
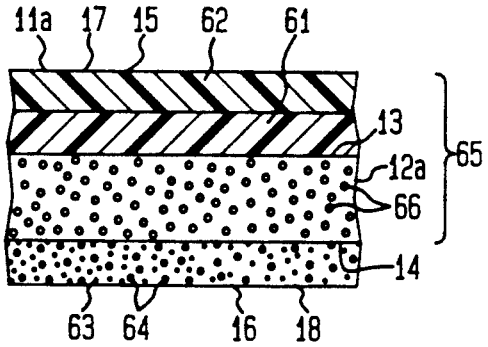
FIG. 3 is a view, similar to FIG. 2, showing an alternative foam substrate form of the coated sheet.

Referring now to FIG. 3, an alternative form sheet 11*a* is shown in sectional view which is identical to sheet 11 of FIG. 2, except that sheet 11*a* has a substrate 12*a* formed of a polymer film, instead of paper. The polymer film is a minute void (hollow bubble) filled foam structure, e.g., of polyethylene terephthalate, having a multiplicity of minute voids 66 distributed therein to provide substrate 12*a* with an increased degree of thermal insulation. This foam structure type polymeric film enables substrate 12*a* to have a smaller thickness than that of a void-free polymeric film of the same thermal resistance.

Accordingly, it can be appreciated that the specific embodiments described are merely illustrative of the general principles of the invention. Various modifications may be provided consistent with the principles set forth.

What is claimed is:

1. A coated sheet for two sided thermal printing comprising:

a thermally insulating substrate defining opposed first and second surfaces;

the first surface having a dye receiving, thermally insulating first coating for forming a dye transfer image thereon upon selective thermal transfer of heat flowable dye thereto from an extraneous dye transfer source by thermal printing means in a transfer printing step, the first coating defining a third surface;

the second surface having a second coating containing heat activated dye material for forming, in situ, a dye image upon selective applying of heat directly thereto by thermal printing means in an in situ printing step, the heat activated dye material being normally colorless and changing to a color state in situ upon heat activation, and the second coating defining a fourth surface remote from the third surface; and the sheet defining in cross section a composite portion between the third surface and the second surface having a sufficient thickness and thermal resistance for inhibiting heat transfer therethrough from the third surface to the second surface during the transfer printing step to prevent activation of the dye material in the second coating;

wherein the heat activated dye material is activated at a given thermal activation temperature, the thermal resistance of the composite portion is the reciprocal of the corresponding mean thermal conductivity of the composite portion, and the thickness and thermal resistance of the composite portion are such that the product of the heat which is transferred through the composite portion from the third surface to the second surface during the transfer printing step, times the thickness of the composite portion, times the mean thermal conductivity of the composite portion, constitutes a value which is below the activation temperature of the heat activated dye material.

2. The sheet of claim 1 wherein the first coating comprises an inner layer of a compliant polymer overcoated with an outer layer of a substantially non-compliant, heat deflecting, transfer dye receptive polymer for forming the dye transfer image thereon, the outer layer defining the third surface.

3. The sheet of claim 2 wherein the second coating has a selective thickness and the composite portion has a thickness at least three to six times the second coating thickness.

4. The sheet of claim 3 wherein the first coating comprises an inner layer of polyethylene or polypropylene overcoated with an outer layer of polycarbonate.

5. The sheet of claim 1 wherein the second coating comprises a binder matrix containing heat activated dye material comprising a mixture of particles of a normally colorless dye precursor and particles of a color developer therefor which upon heat activation undergo a color developing reaction to change the dye precursor to a color state.

6. The sheet of claim 5 wherein the binder matrix comprises starch or polyvinyl alcohol.

7. The sheet of claim 1 wherein the substrate comprises paper.

8. The sheet of claim 1 wherein the substrate comprises a polymer film.

9. The sheet of claim 1 wherein the substrate comprises a polymer film in the form of a minute void filled foam structure.

10. The sheet of claim 1 wherein the substrate has a thickness of about 0.00200 to 0.00500 inch, the first coating has a thickness of about 0.00105 to 0.00160 inch, and the second coating has a thickness of about 0.00050 to 0.00100 inch.

11. A coated sheet for two sided thermal printing comprising:

a thermally insulating substrate defining opposed first and second surfaces;

the first surface having a dye receiving, thermally insulating first coating for forming a dye transfer image thereon upon selective thermal transfer of heat flowable dye thereto from an extraneous dye transfer source by thermal printing means in a transfer printing step, the first coating defining a third surface;

the second surface having a second coating containing heat activated dye material for forming, in situ, a dye image upon selective applying of heat directly thereto by thermal printing means in an in situ printing step, the heat activated dye material being normally colorless and changing to a color state in situ upon heat activation, and the second coating defining a fourth surface remote from the third surface; and the sheet defining in cross section a composite portion between the third surface and the second surface having a sufficient thickness and thermal resistance for inhibiting heat transfer therethrough from the third surface to the second surface during the transfer printing step to prevent activation of the dye material in the second coating;

wherein the second coating has a selective thickness and the composite portion has a thickness at least three to six times the second coating thickness, the heat activated dye material is activated at a given thermal activation temperature, the thermal resistance of the composite portion is the reciprocal of the corresponding mean thermal conductivity of the composite portion, and the thickness and thermal resistance of the composite portion are such that the product of the heat which is transferred through the composite portion from the third surface to the second surface during the transfer printing step, times the thickness of the composite portion, times the mean thermal conductivity of the composite portion, constitutes a value which is below the activation temperature of the heat activated dye material.

12. A method for two sided thermal printing of a coated sheet, the coated sheet comprising:

a thermally insulating substrate defining opposed first and second surfaces;

the first surface having a dye receiving, thermally insulating first coating for forming a dye transfer image thereon upon selective thermal transfer of heat flowable dye thereto from an extraneous dye transfer source by thermal printing means in a transfer printing step, the first coating defining a third surface;

the second surface having a second coating containing heat activated dye material for forming, in situ, a dye image upon selective applying of heat directly thereto by thermal printing means in an in situ printing step, the heat activated dye material being normally colorless and changing to a color state in situ upon heat activation, and the second coating defining a fourth surface remote from the third surface; and the sheet defining in cross section a composite portion between the third surface and the second surface having a sufficient thickness and thermal resistance for inhibiting heat transfer therethrough from the third surface to the second surface during the transfer printing step to prevent activation of the dye material in the second coating; and the method comprising the steps of:

carrying out the transfer printing step to form a dye transfer image in the first coating and the in situ printing step to form, in situ, a dye image in the second coating, such that heat transfer through the composite portion from the third surface to the second surface is inhibited during the transfer printing step to prevent activation of the dye material in the second coating.

13. The method of claim 12 wherein the transfer printing step is carried out before the in situ printing step.

14. The method of claim 12 wherein the transfer printing step is carried out after the transfer printing step.

15. The method of claim 12 wherein the second coating has a selective thickness and the composite portion has a thickness at least three to six times the second coating thickness.

16. The method of claim 12 wherein the heat activated dye material is activated at a given thermal activation temperature, the thermal resistance of the composite portion is the reciprocal of the corresponding mean thermal conductivity of the composite portion, and the thickness and thermal resistance of the composite portion are such that the product of the heat which is transferred through the composite portion from the third surface to the second surface during the transfer printing step, times the thickness of the composite portion, times the mean thermal conductivity of the composite portion, constitutes a value which is below the activation temperature of the heat activated dye material.

17. A method for two sided thermal printing of a coated sheet, the coated sheet comprising:

a thermally insulating substrate defining opposed first and second surfaces;

the first surface having a dye receiving, thermally insulating first coating for forming a dye transfer image thereon upon selective thermal transfer of heat flowable dye thereto from an extraneous dye transfer source by thermal printing means in a transfer printing step, the first coating defining a third surface;

the second surface having a second coating containing heat activated dye material for forming, in situ, a dye image upon selective applying of heat directly thereto by thermal printing means in an in situ printing step, the heat activated dye material being normally colorless and changing to a color state in situ upon heat activation, and the second coating defining a fourth surface remote from the third surface; and the sheet defining in cross section a composite portion between the third surface and the second surface having a sufficient thickness and thermal resistance for inhibiting heat transfer therethrough from the third surface to the second surface during the transfer printing step to prevent activation of the dye material in the second coating;

wherein the second coating has a selective thickness and the composite portion has a thickness at least three to six times the second coating thickness, the heat activated dye material is activated at a given activation temperature, the thermal resistance of the composite portion is the reciprocal of the corresponding mean thermal conductivity of the composite portion, and the thickness and thermal resistance of the composite portion are such that the product of the heat which is transferred through the composite portion from the third surface to the second surface during the transfer printing step, times the thickness of the composite portion, times the mean thermal conductivity of the composite portion, constitutes a value which is below the activation temperature of the heat activated dye material; and the method comprising the steps of:

carrying out the transfer printing step to form a dye transfer image in the first coating and the in situ printing step to form, in situ, a dye image in the second coating, such that heat transfer through the composite portion from the third surface to the second surface is inhibited during the transfer printing step to prevent activation of the dye material in the second coating.

* * * * *